US006283193B1

(12) United States Patent
Finch et al.

(10) Patent No.: US 6,283,193 B1
(45) Date of Patent: Sep. 4, 2001

(54) ADJUSTABLE TENSIONING ARRANGEMENT FOR MODULAR SECURITY DOOR SYSTEM

(76) Inventors: Harry E. Finch, P.O. Box 891573, Temecula, CA (US) 92589; Geza J. Szayer, 7 Addington Rd., Coto de Caza, CA (US) 92679

( * ) Notice: Subject to any disclaimer, the term of this patent is extended or adjusted under 35 U.S.C. 154(b) by 0 days.

(21) Appl. No.: 09/610,230

(22) Filed: Jul. 5, 2000

Related U.S. Application Data

(60) Provisional application No. 60/142,441, filed on Jul. 6, 1999.

(51) Int. Cl.[7] ..... E05F 11/00
(52) U.S. Cl. ..... 160/191
(58) Field of Search ..... 160/133, 191, 160/192, 313, 315; 16/197, 198

(56) References Cited

U.S. PATENT DOCUMENTS 4,930,182 * 6/1990 Eichenberger ..... 160/191 X
4,930,563 * 6/1990 Finch et al. ..... 160/133 X
4,981,165 * 1/1991 Miller et al. ..... 160/191
5,778,490 * 7/1998 Curtis ..... 160/191 X
5,865,235 * 2/1999 Krupke et al. ..... 160/191

* cited by examiner

*Primary Examiner*—David M. Purol
(74) *Attorney, Agent, or Firm*—Henry M. Bissell; Henry M. Bissell, IV

(57) ABSTRACT

An adjustable tensioning arrangement for modular security door systems has modular components interchangeable for use on either side of the door system, thereby reducing significantly the number of parts which must be manufactured for the door. The adjustable tensioning arrangement is capable of accommodating a variety of tensions desired by individual users. The adjustable tensioning arrangement may be produced with a minimal number of required parts, and at very low cost. Construction of the adjustable tensioning arrangement may incorporate readily fabricated steel components, or utilize injection molded or other plastic type materials.

14 Claims, 6 Drawing Sheets

ADJUSTABLE TENSIONING ARRANGEMENT FOR MODULAR SECURITY DOOR SYSTEM

CROSS-REFERENCE TO RELATED APPLICATION

This application claims the benefit of U.S. Provisional Application No.: 60/142,441, filed Jul. 6, 1999.

BACKGROUND OF THE INVENTION

1. Field of the Invention

The present invention relates generally to a roll-up or curtain type modular security door system and, more particularly, to an improved adjustable tensioning arrangement for torsion springs utilized with modular, roll-up or curtain type security door systems.

This application relates to an improvement of U.S. Pat. No. 4,930,563, issued to Finch, et al., the disclosure of which is incorporated herein by reference as though set forth herein in haec verba.

2. Description of the Related Art

With ever-increasing urban crowding, the demand for storage space for infrequently used personal property has grown sharply. Such storage space, which used to be in a garage or basement, is not available in most apartments and condominiums, resulting in the development of the mini-warehouse or mini-storage facility. This type of facility features a secure, lockable storage space which is rented mainly to individuals. Since a wide variety of property may be stored in such facilities, including furniture and other large items, it is desirable to provide a large sealable door to provide access to individual storage areas. This eliminates conventional doors for the most part, since they are either too small or too unwieldy to be acceptable to the public.

Roll-up or curtain doors represent a convenient way to provide an easily operable closure, and they do so in a fairly limited space. Roll-up doors are typically constructed using a sheet of relatively thin metal which is formed by stamping or rolling to provide a plurality of horizontal corrugations extending the entire width of the door. This construction allows the door to be rolled up as it is raised for opening, thereby allowing the door to be stored in a cylindrical configuration at the top of the door opening., Vertical guide tracks, which may be made of extruded aluminum or formed galvanized steel, are typically mounted at opposite sides of the door opening and serve to guide the door as it moves up and down.

The top of the formed metal sheet is fastened to a barrel assembly which is constructed with a heavy wall, steel tube axle which supports thereon two or more galvanized steel drums or wheels. The barrel assembly is rotatably mounted between two brackets located slightly above the upper corners of the door opening. The barrel assembly is biased by one or two tempered steel torsion springs to balance the weight of the roll-up door, thereby allowing the door to be easily raised or lowered in a simple one-hand operation. Adhesively affixed tapes extend along the inner face of the door where contact is made with the galvanized steel drums or wheels to protect the door against wear by the galvanized steel drums or wheels, and to avoid rubbing of the successive layers of the roll-up door against each other.

The door also has a locking mechanism mounted thereon, which may be a simple sliding bolt type lock. With this mechanism, when the door is closed the bolt slides into a locking engagement with the guide track or with other metal means which prevents the door from being opened unless the bolt is opened. A simple padlock owned by the storage user may then be used to lock the bolt assembly.

This type of roll-up door is easy to operate, and will provide years of dependable service with virtually no maintenance. Such doors are relatively inexpensive, particularly when compared to similar roll-up doors which are made of a plurality of interlocking slats or panels.

Roll-up or curtain type doors represent a convenient way to provide an easily operable and secure closure. Spring arrangements, often involving torsion springs, are frequently used to ease the task of raising or lowering such doors.

In order to provide the desired reduction in force required to raise or lower a door, a spring arrangement must be properly tensioned. Frequently, this tensioning is performed during the construction or installation of the security door assembly. Because of this fact, the tensioning arrangement is fixed, and not easily adjustable to suit the particular needs of individual users. The degree of tensioning preferred by individual users varies over a wide range, and spring tensions set by a manufacturer during construction or unit assembly cannot accommodate this variability.

From the preceding description, it will be appreciated that such doors are relatively easy to manufacture, and the business of manufacturing them is quite competitive. Accordingly it is desirable to minimize the cost of manufacturing the doors as much as possible while still retaining a high degree of quality and reliability. The minimization of the number of different parts required is an objective which reduces the cost of manufacturing, and also reduces the number of different parts which must be stocked.

Minimizing the quantity of hardware components such as nuts and bolts is also desirable, from two standpoints. First, the cost factor mandates using the smallest number of hardware items necessary. Secondly, and even more importantly, since such doors are sold in complete kits, it is desirable to minimize the number of parts and by so doing the amount of assembly required. Owners of storage facilities must either install the doors themselves, or pay to have the doors installed. It is apparent that a door which is simple, easy, and quick to install will have a significant competitive advantage over doors that are not.

It will be appreciated that providing an easily adjustable tensioning arrangement for modular security door systems is desirable. Given that the business of manufacturing modular security door systems is quite competitive, it is also desirable to minimize the cost of manufacturing such an adjustable tensioning arrangement while still retaining a high degree of product quality and reliability. The minimization of the number of different parts required to be designed and fabricated serves to reduce the costs of manufacturing.

Accordingly, it is an objective of the present invention to develop a design minimizing the number of parts needed in fabricating a curtain type door, thereby reducing the cost and the amount of work necessary to install the door. To the greatest degree possible, the door should be of a modular design which further facilitates both kitting and installation. The door must be installable using only simple hand tools, and it must be simple to install. The tensioning arrangement must be capable of accommodating the tensions desired by individual users. Finally, the door must accomplish all of the aforesaid advantages while maintaining the highest degree of quality, durability, and dependability, and presenting no relative disadvantage.

SUMMARY OF THE INVENTION

The advantages discussed above are realized by the present invention. With this invention, the number of parts necessary for assembly of the door is reduced in two ways. First, and most significantly, the main components of the door are modular in design, and may be used on either side of the door. In other words, there are no longer right side and left side components; rather, the various parts are usable on either side of the door. This presents several advantages. The number of different parts which must be fabricated and stocked by the manufacturer is reduced significantly, since previously a number of the major components of the door were required to be manufactured in right side and left side versions, which were not interchangeable. In addition, the installer of the door need not worry about which side a particular part is designed to fit; instead, the part will fit either side interchangeably.

The second reduction in the number of parts required is obtained by minimizing the number of hardware items required. Insofar as possible, the assembly of the door is accomplished without hardware items such as bolts, nuts, and screws. This reduces the cost of the door, and also makes the assembly much easier and quicker. For example, the brackets used to secure the door guide tracks to the sides of the door opening slideably engage with the guide tracks instead of requiring bolts, nuts, and washers to secure them. The brackets used to carry the barrel assembly are similarly engaged onto the guide tracks, and require only a single bolt to retain them in place.

The reduction in parts is obtained at no cost in quality, durability, or long term dependability whatsoever. The roll-up doors of the present invention may be manufactured at lower cost and sold at reduced prices, giving them a tremendous competitive advantage over prior art roll-up doors. The installation of the doors is quicker and easier, and the door is just as secure. It will therefore be appreciated that the roll-up door of the present invention offers significant advantages over the art while incurring no relative disadvantage whatsoever.

With this invention, an easily adjustable tensioning arrangement for modular security door systems is provided. The adjustable tensioning arrangement may be produced with a minimal number of required parts, and at very low cost.

The use of readily fabricated steel or other metal components for construction of the present invention serves to reduce the cost of manufacture. Alternately, the present invention may incorporate components made from injection molded or other plastic type materials. Furthermore, the incorporation by the present invention of unitary construction methods aids in reducing both the number of required parts and costs of manufacturing.

BRIEF DESCRIPTION OF THE DRAWINGS

These and other advantages of the present invention are best understood with reference to the drawings, in which.

DETAILED DESCRIPTION OF THE PREFERRED EMBODIMENT

Figure 1:
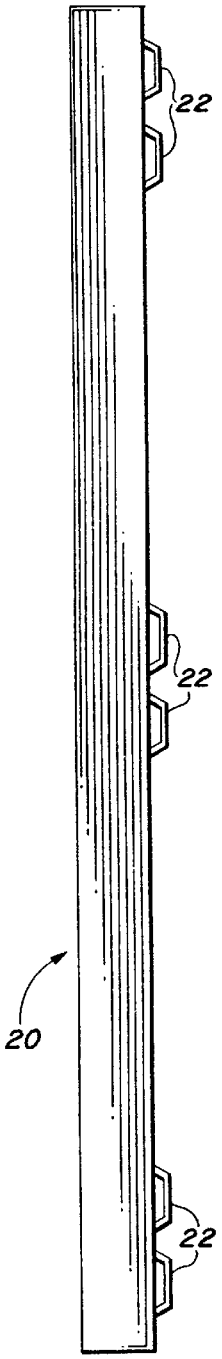
FIG. 1 is a side view of the interchangeable guide track used to support a roll-up door of the type described on the left or right side thereof, illustrating the notches formed on the side thereof.
Figure 2:
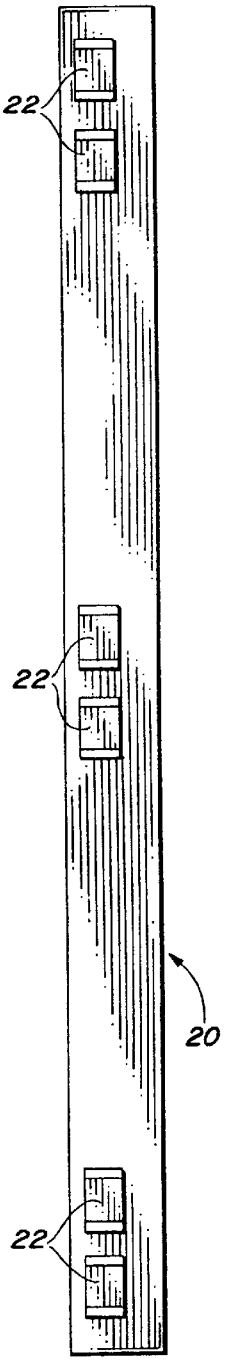
FIG. 2 is a back view of the interchangeable guide track shown in FIG. 1.
Figure 3:
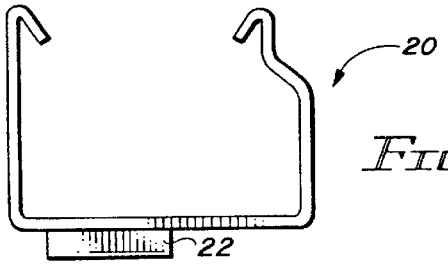
FIG. 3 is an end view of the interchangeable guide track shown in FIGS. 1 and 2, illustrating the bends therein.

The guide tracks used in previously known roll-up doors are typically made for either the right side or the left side of the door, and are not generally interchangeable. FIGS. 1 to 3 illustrate a guide track 20 which is used in the present invention interchangeably for either the right or left track. The guide track 20 of the preferred embodiment is formed of galvanized steel sheet stock bent as best shown in FIG. 3.

The guide track 20 has a plurality of pairs of retaining slots 22 formed therein to receive tabs, which will be described below in conjunction with FIG. 4. The retaining slots 22 are stamped into the guide track 20 at the time it is manufactured. One pair of the retaining slots 22 is located at each end of the guide track 20. The spacing between the retaining slots 22 is identical at each end of the guide track 20. Additional pairs of the retaining slots 22 may be located between the pairs of retaining slots 22 at either end of the guide track 20, depending on the length of the guide track 20. The guide track 20 shown in the FIGS. have one such additional pair of retaining slots 22.

Figure 4:
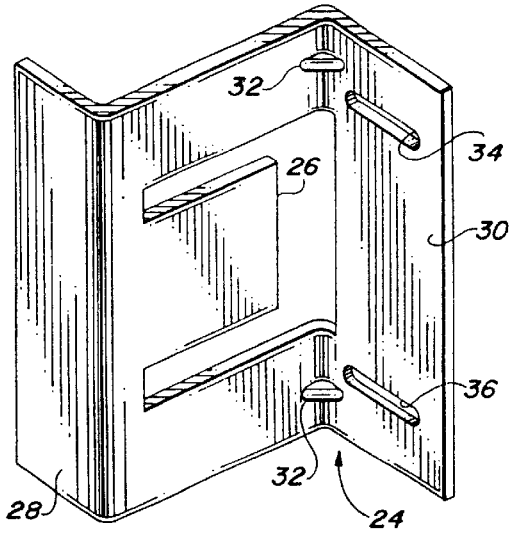
FIG. 4 is a perspective view of the brackets used to support the guide track shown in FIG. 1–3.

Referring next to FIG. 4, a mounting bracket 24 which may be used to mount the guide track 20 in position on the side of the opening into which the door is to be installed is illustrated. The mounting bracket 24, which is preferably made of stamped steel stock, has a tab 26 designed to precisely engage one of the retaining slots 22. When the mounting bracket 24 is installed into one of the retaining slots 22, it may be slid into the retaining slot 22 from the left of the guide track 20 as shown in FIG. 2. When the tab 26 is fully inserted into the retaining slot 22, a portion 28 of the mounting bracket 24 bent 90 degrees from the portion of the mounting bracket 24 containing the tab 26 will be flat against back side of the guide track 20 shown in FIG. 1.

A mounting portion 30 of the mounting bracket 24 is also bent 90 degrees from the portion of the mounting bracket 24 containing the tab 26. The mounting portion 30 is maintained in its 90 degree relationship by two stiffener protrusions 32 which are stamped into the mounting bracket 24. A first slot 34 and a second slot 36 are located on the mounting bracket 24. The first and second slots 34, 36 are of different sizes to allow different size mounting hardware to be used to attach the mounting brackets to the side of the opening into which the door is to be installed. Only one of the two slots 34, 36 will generally be used in the installation of the door; having two different sizes of slots allows different sizes of hardware to be used as available or at the option of the installer.

It should also be noted that only one mounting bracket 24 will generally be used in each pair of retaining slots 22. The installer will have the option of deciding which of the pair of retaining slots 22 the mounting bracket 24 is installed into. The purpose of having the retaining slots 22 in pairs will become evident later, in conjunction with the discussion of FIGS. 9 and 10. It will be appreciated that in accordance with the principles of the present invention, the mounting bracket 24 is installed into the retaining slot 22 without needing additional hardware, thereby saving both the cost of such hardware and the time needed to install such hardware.

Figure 5:
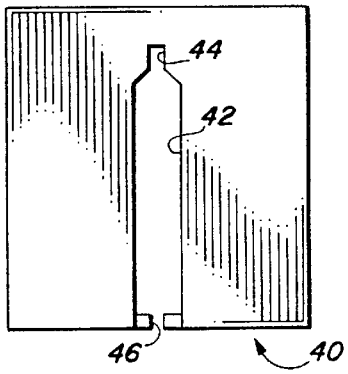
FIG. 5 is a side view of one of the barrel assembly U-shaped support brackets.
Figure 6:
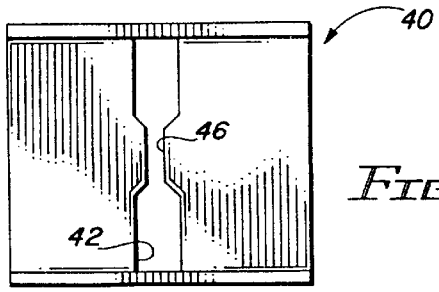
FIG. 6 is a top view of the U-shaped support bracket shown in FIG. 5.
Figure 7:
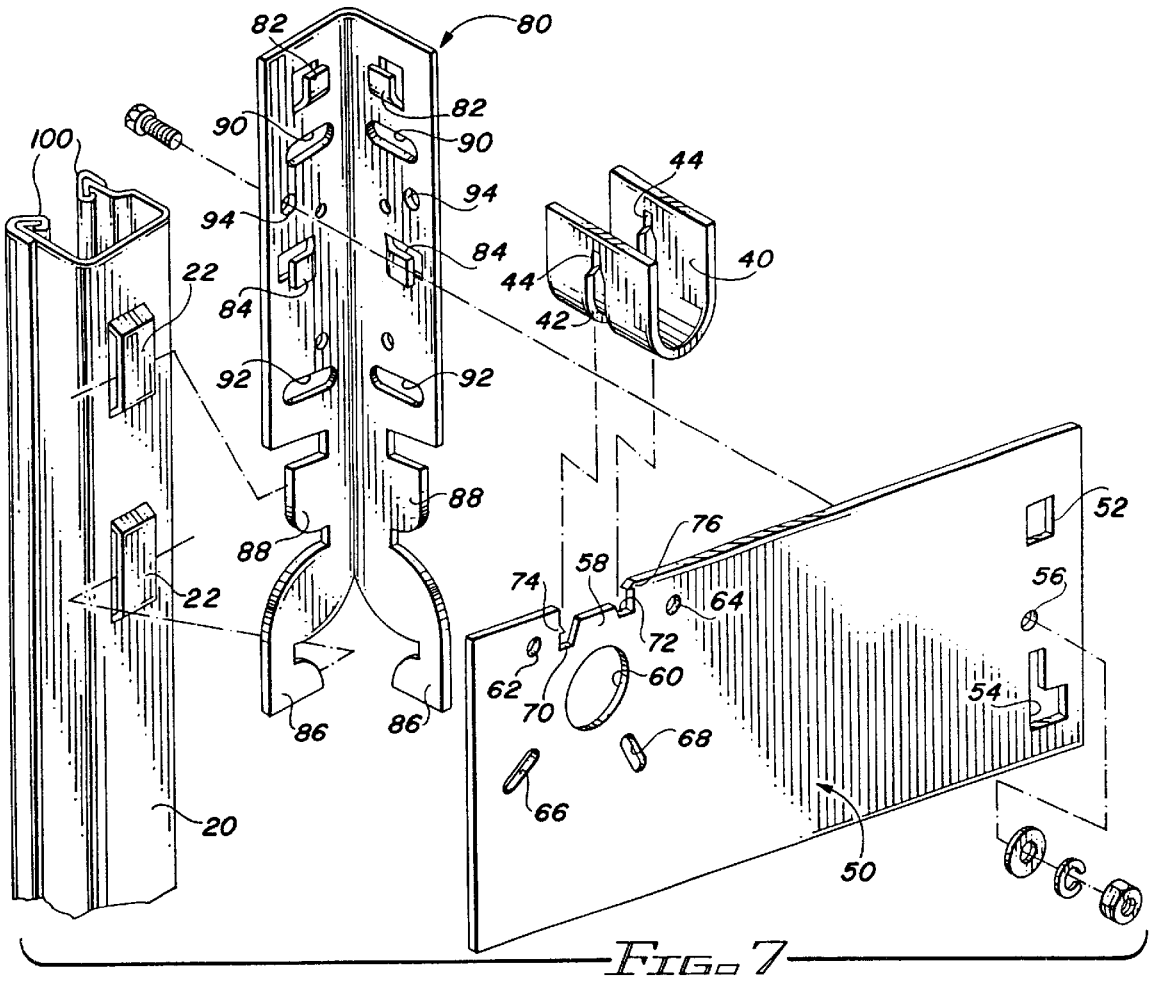
FIG. 7 is an exploded perspective view of the interchangeable guide track of FIGS. 1–3, the U-shaped support bracket of FIGS. 5 and 6, the main barrel assembly support plate, and the plate support bracket.
Figure 10:
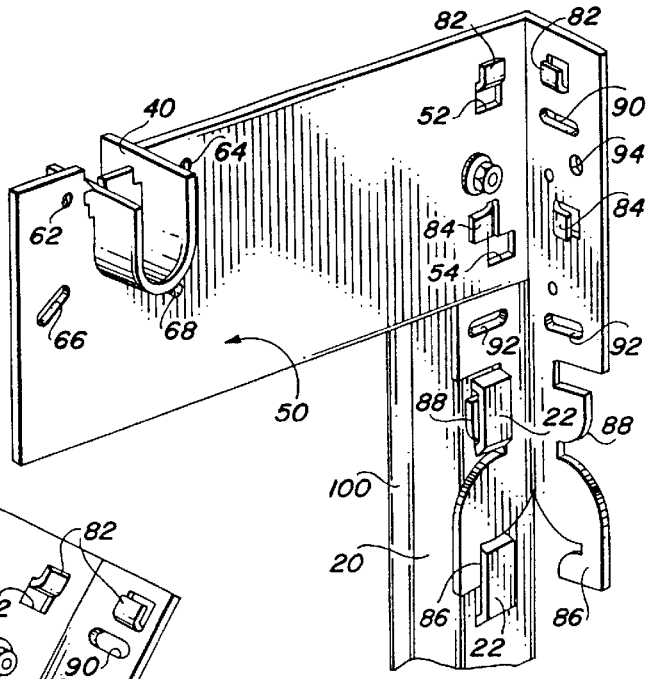
FIG. 10 is a perspective view of the assembled main barrel assembly support plate and plate support bracket fully installed at the top of the guide track.

Referring now to FIGS. 5–7, and also to FIG. 10, for example, a U-shaped support bracket 40 is illustrated, which U-shaped support bracket 40 will be used to support the barrel assembly, to be discussed later in conjunction with FIG. 11. The U-shaped support bracket 40 has a notch 42 therein, the notch 42 extending throughout the curved section of the U-shaped support bracket 40 and up much of the length of the legs of the U-shaped support bracket 40. The notch 42 has narrowed portions 44 at the ends of the notch 42 near the tops of the legs of the U-shaped support bracket 40. The notch 42 also has a narrowed portion 46 at the bottom of the curved portion of the notch 42.

Referring now to FIG. 7, a main barrel assembly support plate 50 is shown. At one end of the support plate 50, there are two notches in the support plate 50, one above the other. The upper notch is a rectangular notch 52, and the lower notch is an L-shaped notch 54. Located roughly between the rectangular notch 52 and the L-shaped notch 54 is an aperture 56.

Near the other end and at the top of the support plate 50 is an irregularly shaped notch 58. Directly under the irregularly shaped notch 58 is a large circular aperture 60. Surrounding the large circular aperture 60 at approximately 90 degree intervals are two apertures 62, 64 and two notches 66, 68. The irregularly shaped notch 58 has a first deeper portion 70, and a second deeper portion 72. The first deeper portion 70 is nearer the end on the support plate 50 not having the rectangular notch 52 and the L-shaped notch 54 therein, while the second deeper portion 72 is nearer the end on the support plate 50 having the rectangular notch 52 and the L-shaped notch 54 therein. The first deeper portion 70 is also deeper than the second deeper portion 72, for reasons which will become evident later.

The irregularly shaped notch 58 has at the end nearer the end on the support plate 50 not having the rectangular notch 52 and the L-shaped notch 54 therein a retaining projection 74, which retaining projection 74 is located approximately half way down the first deeper portion 70. The irregularly shaped notch 58 also has at the end nearer the end on the support plate 50 having the rectangular notch 52 and the L-shaped notch 54 therein a second retaining projection 76, which retaining projection 76 is located near the top of the first deeper portion 70.

When the U-shaped support bracket 40 is placed into the irregularly shaped notch 58 with the rounded portion of the U downward, the top of the U-shaped support bracket 40 immediately above the narrowed portions 44 is forced past the retaining projections 74, 76. The retaining projections 74, 76 then act to retain the U-shaped support bracket 40 in the position shown, for example, in FIGS. 9 and 10.

The narrowed portions 44 of the U-shaped support bracket 40 will grip the portions of the support plate 50 located immediately below the deeper portions 70, 72. Likewise, the narrowed portion 46 at the bottom of the U-shaped support bracket 40 will grip the portion of the support plate at the bottom of the large circular aperture 60. It should be noted that the U-shaped support bracket 40 fits onto the support plate 50 so a shaft supported within the rounded portion of the U-shaped support bracket 40 will not contact the large circular aperture 60, which has a slightly larger diameter than the diameter of the rounded portion of the U-shaped support bracket 40. The bottom of the U-shaped support bracket 40 will also be directed slightly toward the end on the support plate 50 having the rectangular notch 52 and the L-shaped notch 54 therein a second retaining projection 76, since when the barrel assembly and the door are installed the force will help to retain the U-shaped support bracket 40 in the irregularly shaped notch 58.

Figure 8:
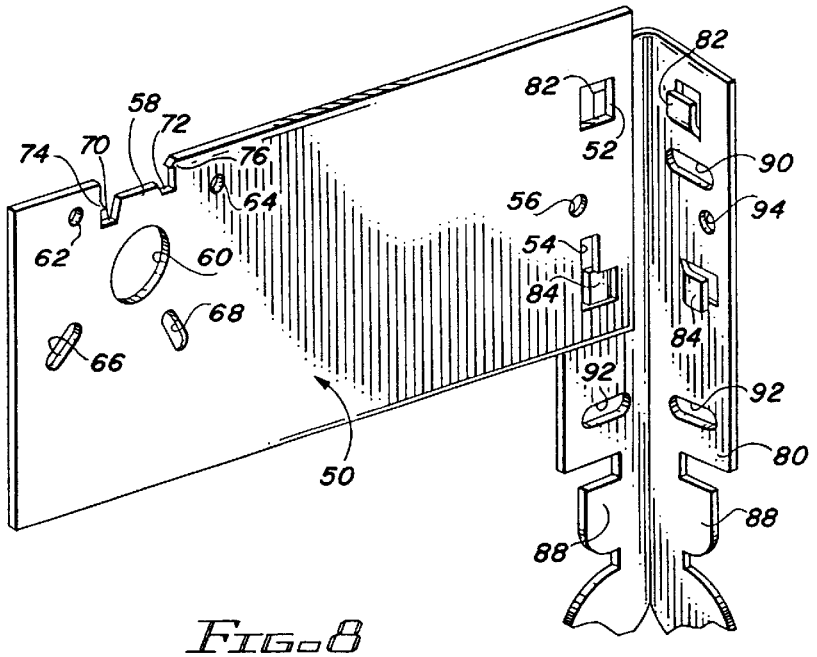
FIG. 8 is a perspective view of the main barrel assembly support plate being installed onto the plate support bracket.

Referring to FIG. 8, the installation of the support plate 50 onto a plate support bracket 80 is shown. The plate support bracket 80 is made from a piece of flat stock bent to have a 90 degree bend therein, as shown. The entire portions of the plate support bracket 80 on each side of the bend are mirror images. Two tabs are located on each side of the bend and on the top portion of the plate support bracket 80, with each tab being parallel to and spaced away from the surface of the plate support bracket 80. A first tab 82 is near the top of the plate support bracket 80 on each side of the bend, and the open end of the first tab 82 faces upwardly. A second tab 84 is below the first tab 82 on the plate support bracket 80 on each side of the bend, and the open end of the second tab 84 faces away from the bend on the plate support bracket 80.

Two additional tabs are located on each side of the bend and on the bottom portion of the plate support bracket 80, with each of these tabs being formed by material cut away from the plate support bracket 80. A third tab 86 is located at the bottom of the plate support bracket 80 on each side of the bend, and the third tab 86 faces toward the line defined by the bend. A fourth tab 88 is located above the third tab 86 on each side of the bend, and faces away from the line defined by the bend. The fourth tabs 88 are directly above the respective third tabs 86, and it will be appreciated that the third and fourth tabs 86, 88 will fit into two slots located one above the other, as will become evident as described below in conjunction with FIGS. 9 and 10.

Also located on the plate support bracket 80 on each side of the bend therein are two slots. A first slot 90 between the first tab 82 and the second tab 84 and a second slot 92 between the second tab 84 and the fourth tab 88 are of different sizes to allow different size mounting hardware to be used therein. One side of the plate support bracket 80 will be fastened to the side of the opening into which the door is to be installed; the other side is used to hold the support plate 50. Only one of the two slots 90, 92 will generally be used in the installation of the door. Located between the second tab 84 and the first slot 90 on each side of the bend is an aperture 94.

Figure 9:
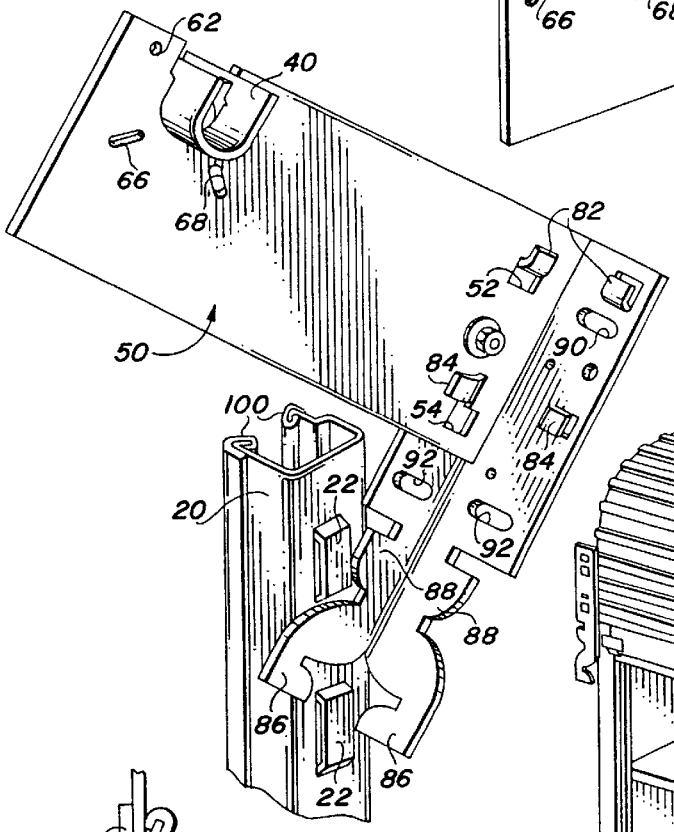
FIG. 9 is a perspective view of the assembled main barrel assembly support plate and plate support bracket being installed at the top of the guide track.

The installation of the support plate 50 onto the plate support bracket 80 may now be described. As shown in FIG. 8, the second tab 84 is inserted into the bottom portion of the L-shaped notch 54. The support plate 50 is then pushed toward the bend in the plate support bracket 80, causing the second tab 84 to move to engage the surface of the support plate 50 around the L-shaped notch 54, and also causing the first tab 82 to fit through the rectangular notch 52. The support plate 50 is then moved downwardly with respect to the plate support bracket 80, causing the second tab 84 to move upward into the top of the L-shaped notch 54, and also causing the first tab 82 to engage the surface of the support plate 50 above the rectangular notch 52, as shown in FIGS. 9 and 10, for example. A bolt (not shown in FIG. 7) may be inserted through the aperture 56 and the aperture 94 to secure the support plate 50 to the plate support bracket 80.

Referring now to FIG. 9, the installation of the plate support bracket 80 onto the top of the guide track 20 is illustrated. The top two retaining slots 22 in the guide track 20 are used to support the plate support bracket 80. The fourth tab 88 is inserted into the top one of the retaining slots 22, and the third tab 86 is inserted into the next lower one of the retaining slots 22 with the plate support bracket 80 at an angle to the guide track 20 as shown in FIG. 9.

The plate support bracket 80 is then brought to an upright position bringing it in line with the guide track 20, causing the fourth tab 88 to be fully inserted into the top one of the retaining slots 22, and the third tab 86 to be fully inserted into the next lower one of the retaining slots 22. It will be appreciated that the weight of the barrel assembly (not shown in FIGS. 9 and 10, but suspended from the U-shaped support bracket 40) will maintain the fourth tab 88 in a fully inserted position in the top one of the retaining slots 22, and the third tab 86 in a fully inserted position in the next lower one of the retaining slots 22.

Figures 11, 12:
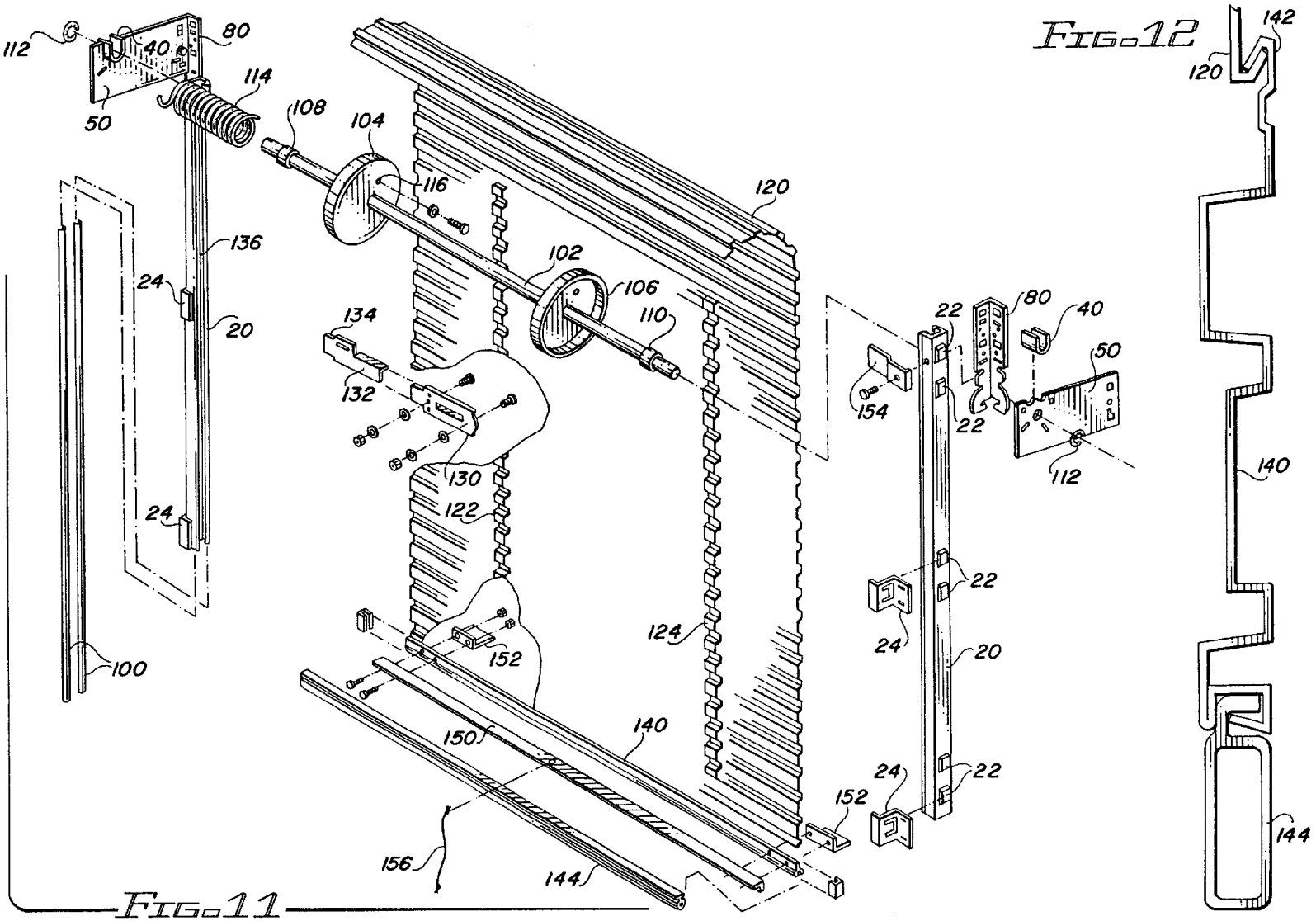
FIG. 11 is an exploded perspective view of the entire roll-up door of the present invention illustrating the construction thereof.
FIG. 12 is a side view of the bottom edge of the door, which bottom edge is made of a formed metal sheet and fastened to the lower edge of the door in a double re-entrant joint.

Moving now to FIG. 11, the complete assembly of the present invention may be explained and understood. It will be immediately understood by those skilled in the art that the components described up to this point herein are universal; in other words, the same component may be used and will fit on either side of the roll-up door. The guide track 20 is the first such component, and may be used on opposite sides by merely turning it end-for-end. The retaining slots 22 are located equidistant from each end, and therefore only one guide track 20 need be manufactured instead of distinct left and right guide tracks. The mounting bracket 24 may also be used in any of the multiple retaining slots 22 on a guide track 20 on either side of the door.

As discussed above, the plate support bracket 80 is made of two portions on each side of the bend therein which are mirror images of each other. This enables the plate support bracket 80 to be used on either side of the door. One face of the plate support bracket 80 will be directed inwardly with respect to the opening in which the door is situated. The other face of the plate support bracket 80 will be directed directly away from the opening, and as such will lie flat against the wall adjacent the opening. Again, since the plate support bracket 80 will fit on either side of the door, only one plate support bracket 80 need be manufactured.

The support plate 50 is entirely of flat construction, and it will be appreciated that the first tab 82 and the second tab 84 may fit into the rectangular notch 52 and the L-shaped notch 54, respectively, from either side. Accordingly, only a single support plate 50 must be manufactured. Likewise, the U-shaped support bracket 40 will fit onto a support plate 50 on either side of the door, so only a single U-shaped support bracket 40 need be manufactured.

The guide tracks 20 have a plastic door slide 100 having a C-shaped or U-shaped cross sectional configuration mounted on each of the two longitudinal edges (FIG. 3) thereof, with the plastic door slides 100 functioning to guide the door when it is raised or lowered. A guide track 20 is installed on each side of the opening immediately inside the edge of the opening, with the side of the guide track 20 on the right as the guide track 20 is shown in FIG. 3 facing the outside of the wall having the opening in which the door is to be installed. A plate support bracket 80 is attached to the top pair of retaining slots 22 on each on the guide tracks 20, with one face of the plate support bracket 80 being directed inwardly with respect to the opening in which the door is situated, and the other face of the plate support bracket 80 being directed directly away from the opening and flat against the walls adjacent the opening therein.

A mounting bracket 24 is mounted in one of each pair of retaining slots 22 in the guide tracks 20, except for the top pair of retaining slots 22 in each guide track 20, which has the plate support bracket 80 mounted therein. The mounting brackets 24 are placed in the one of each pair of the retaining slots 24 which in the opinion of the installer best facilitates attachment of the mounting bracket 24 to the wall surrounding the opening in which the door is being installed. It should also be noted again that the guide tracks 20 may have more pairs of retaining slots 22 therein if the guide tracks are very long.

The guide tracks 20 are retained in place by lag screws or other such hardware (not shown) inserted through at least one of the first and second slots 34, 36 in each of the mounting brackets 24, and through at least one of the first and second slots 90, 92 in each of the plate support brackets 80. As mentioned previously, the different sizes of the first and second slots 34, 36 and the first and second slots 90, 92 enable the use of different sizes of lag bolts or other mounting hardware. Also, only one lag bolt is required to secure each of the mounting brackets 24 and the plate support brackets 80.

The U-shaped support brackets 40 are mounted as previously described onto the support plates 50. The barrel assembly, which is supported by the U-shaped support brackets 40, may now be described. An axle 102 has a pair of support wheels 104, 106 mounted thereon, which support wheels 104, 106 will both support the door and provide a means around which the door may be rolled as it is raised. The axle 102 has a pair of retaining sleeves 108, 110 mounted near the ends thereof. When the ends of the axle 102 are inserted into and supported by the U-shaped support brackets 40, the retaining sleeves 108, 110 prevent lateral movement of the axle 102 in the U-shaped support brackets 40. The ends of the axle 102 preferably extend slightly through the U-shaped support brackets 40, to allow a frictional retaining ring 112 to be slipped over the ends of the axle 102, thereby also retaining the ends of the axle 102 in the U-shaped support brackets 40.

A torsion spring 114 is attached at one end of the axle 102. The torsion spring 114 has at its ends provisions for securing the ends with bolts. One end of the torsion spring 114 is secured to an aperture 116 in the support wheel 104 by a bolt, and the other end of the torsion spring 114 is secured to one of the two apertures 62, 64 or the two notches 66, 68 by a bolt. Although only one torsion spring 114 is shown in FIG. 11, a second torsion spring could be used at the other end of the axle 110. If a second torsion spring is used, it would be secured at one end to the support wheel 106, and at the other end to the support plate 50 at that end of the axle 110.

A formed metal curtain type door 120 is attached to and suspended from the support wheels 104, 106 at the top thereof, as is conventional in the art. The door 120 has on the inside thereof two flexible spacer/runners 122, 124, which are adhesively affixed to the door 120 in line with the positions of the support wheels 104, 106 to absorb the wear occasioned by the door 120 bearing against the support wheels 104, 106, and to prevent abrasion between adjacent rolls when the door 120 is being raised or lowered.

The door 120 has mounted thereon a slide bolt assembly consisting of a slide bolt support member 130 which is mounted to the outside of the door 120 with bolts. Slideably mounted in the slide bolt support member 130 is a slide bolt 132. The slide bolt 132 has a tongue 134 which extends toward the side of the door 120. When the slide bolt 132 is in the open position, the tongue 134 is retracted into the slide bolt support member 130, allowing the door 120 to be opened or closed freely. When the slide bolt 132 is in the closed position, the tongue 134 extends out from the slide bolt support member 130 beyond the edge of the door 120. By having an aperture (not shown) in the guide track 20 to receive the tongue 134, the door 120 may be locked in its fully closed (down) position. The slide bolt support member 130 and the slide bolt 132 have cooperating apertures therein to allow a lock to retain the slide bolt 132 in either a fully closed or a fully opened position.

The bottom edge of the door 120 is reinforced by using a reinforcing beam 140, which is preferably fastened to the bottom of the door 120 by using a double re-entrant joint. The reinforcing beam 140 is preferably made of formed sheet stock, as shown in the cross-sectional illustration of FIG. 12. A double re-entrant joint 142 is formed by inserting a bent portion on the bottom of the door 120 into a cooperating bent portion on the top of the reinforcing beam 140. The bent portions of the door 120 and the reinforcing beam 140 are then pressed together to form a secure joint therebetween. A sealing strip 144 is retained in the bottom of the reinforcing beam 140 to provide a water resistant seal between the bottom of the door 120 and the floor or ground.

Figure 13:
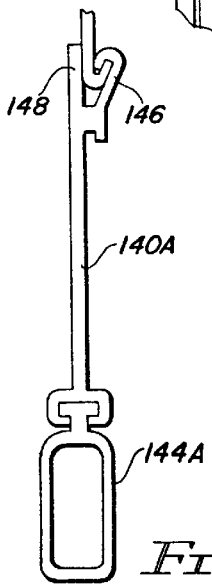
FIG. 13 is a side view of an alternate bottom edge of the door, which alternate bottom edge is made of extruded aluminum.

Alternately, the reinforcing beam 140 may be made using a metal molding, as shown in the reinforcing beam 140A shown in FIG. 13. The reinforcing beam 140A has a hook portion 146 at the top thereof which hook 146 engages the bent portion on the bottom of the door 120. A cooperating planar surface 148 retains the bent portion on the bottom of the door 120 in engagement with the hook 146 when the hook 146 and the planar portion 148 are pressed together, thereby forming a secure joint between the door 120 and the reinforcing beam 140A. A sealing strip 144A is retained in the bottom of the reinforcing beam 140A to provide a water resistant seal on the bottom of the door 120.

Referring again to FIG. 11, a segment of angle iron 150 is shown mounted onto the reinforcing beam 140 on the inside of the door 120. Similarly, on the opposite side of the reinforcing beam 140 two angle segments 152 are mounted, preferably using the same mounting hardware as used to mount the segment of angle iron 150. The angle segments 152 may be used to allow the door 120 to be closed using a foot.

The segment of angle iron 150 is used to restrain the door 120 from being opened too far. A retaining segment 154 is mounted onto one of the guide tracks 20 at the top thereof and on the inside thereof. When the door 120 is fully opened, the segment of angle iron 150 will contact the retaining segment 154, thereby preventing the door 120 from opening further. An additional retaining segment 154 may be similarly mounted on the other guide track 20. Completing the construction of the system, a rope 156 may be attached to the center of the segment of angle iron 150, thereby allowing the door 120 to be easily pulled down. This is particularly useful if the door 120 is too high to allow a user to reach the bottom of the door when it is fully opened.

Figure 14:
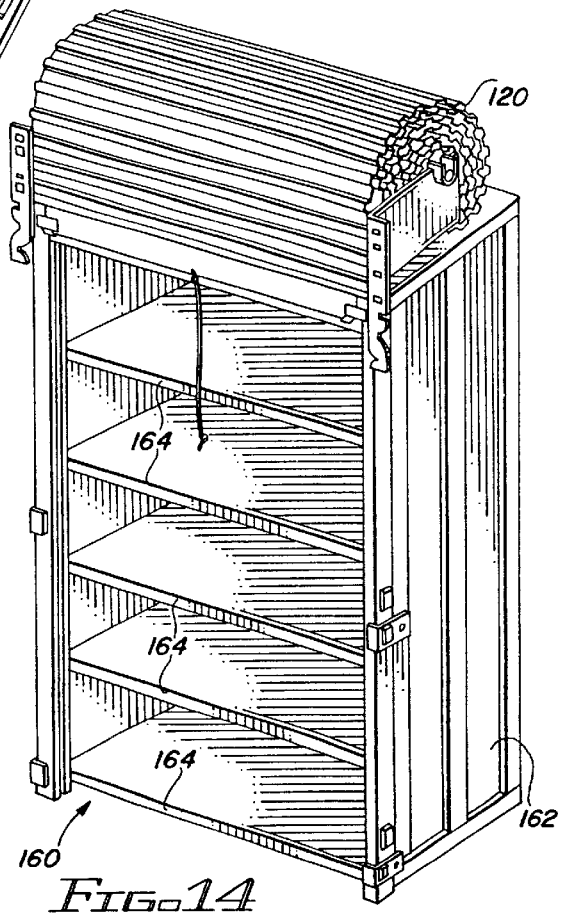
FIG. 14 is a perspective view of a security storage shelf unit using the roll-up door of the present invention.

Referring now to FIG. 14, an alternate embodiment of arrangement of FIGS. 1–3 is shown which uses the door assembly described above to make a secure storage unit 160. By attaching a door such as that described above to the front of a metal shelf unit 162 having a plurality of shelves 164 therein, the storage unit 160 with shelves is made securable. The roll-up door 120 is mounted on guide tracks 20 which are mounted onto the front edges of the sides of the storage unit 162. The barrel assembly (not shown in FIG. 14) is thereby mounted over the top of the shelf unit 162. It will be appreciated that this innovation is highly useful in an industrial setting to store goods or equipment which must be locked up to prevent theft.

Figure 15:
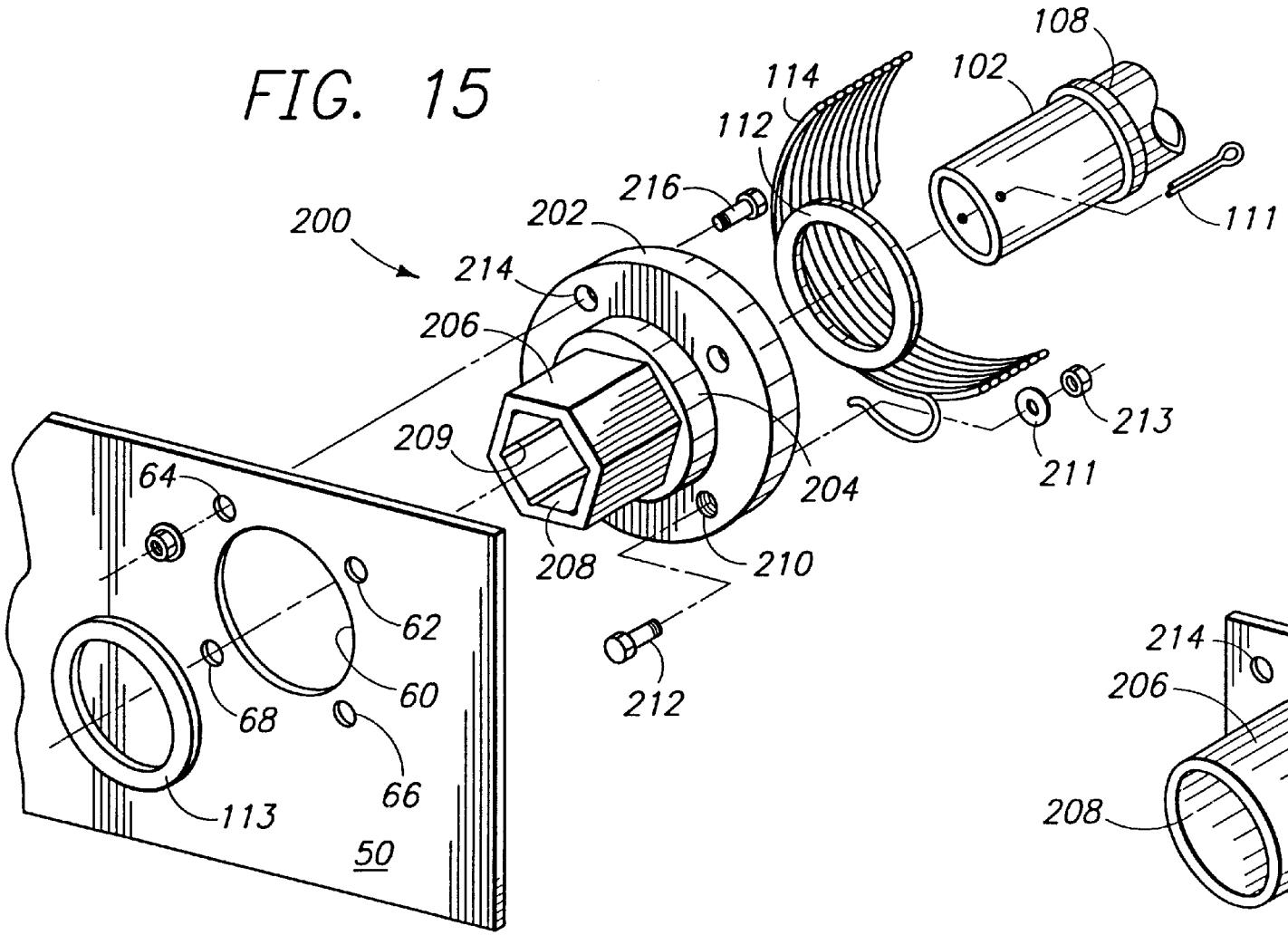
FIG. 15 is an exploded perspective view of the improvement combination of the present invention, showing the torsion spring assembly, the adjustable tensioning arrangement, the axle, and the support plate illustrating the construction thereof.

Referring now to FIG. 15, there is shown an adjustable tensioning arrangement for modular security door systems which may be applied to improve the door assembly described above. A tensioning body 200 has a mounting plate 202 adjacent shoulder 204. Sleeve 206 is formed adjacent shoulder 204 opposite mounting plate 202. Sleeve 206 is provided with multiple planar surfaces ("flats") for engaging an adjustment tool (not shown). Tensioning body 200 defines an axle bore 208 centrally aligned and extending through sleeve 206, shoulder 204 and mounting plate 202. Axle bore 208 is sized to receive axle 102 and is provided with a number of lubrication grooves 209 to permit lubrication of the axle 102 within the bore 208. Support plate 50, corresponding to plate 50 shown in FIG. 7, for example, defines a large circular aperture 60 and smaller circular apertures 62, 64, 66 and 68 surrounding large circular aperture 60 and positioned at approximately 90° intervals surrounding large circular aperture 60. Large circular aperture 60 is adapted to receive sleeve 206 and shoulder 204, providing a bearing surface for shoulder 204.

When assembled, axle 102 extends through torsion spring 114 with optional retaining ring 112 providing a bearing surface between retaining sleeve 108 and the back side (not visible in FIG. 15) of mounting plate 202. Axle 102 extends through axle bore 208 of the tensioning body 200 which is supported by shoulder 204 within circular aperture 60. Axle 102 is retained in place by washer 113 and cotter pin 111. Tensioning body 200 is rotatable within aperture 60 by application of a wrench or similar tool in engagement with the flats on sleeve 206.

Mounting plate 202 has apertures 214 positioned at approximately 90° intervals. The positions of the apertures 214 correspond to the positions of apertures 62, 64, 66, and 68 in support plate 50.

One of the apertures 214 is provided with a recessed portion 210 adapted to receive spring retaining pin 212 in flush cooperation with the face of mounting plate 202. Recessed portion 210 is set into mounting plate 202 on the same side of mounting plate 202 as shoulder 204. When assembled, spring retaining pin 212 extends through the corresponding aperture 214 to engage one end of torsion spring 114 and is retained by washer 211 and nut 213.

To provide adjustment of the tension of torsion spring 114, tensioning body 200 may be rotated by tooled engagement with sleeve 206 until the desired tension adjustment of torsion spring 114 has been achieved. When the tension of torsion spring 114 has been adjusted to the desired setting, apertures 62, 64, 66 and 68 are brought into alignment with apertures 214. Positioning pin 216 is inserted through one of the apertures 214 and a selected one of the apertures 62, 64, 66 or 68 in order to fix the adjustment of the tension of torsion spring 114 at the desired setting.

Figure 16:
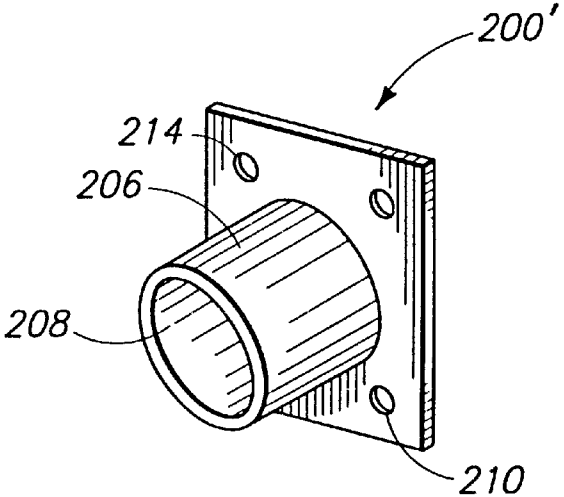
FIG. 16 is a perspective view of an alternate adjustable tensioning arrangement, which alternate tensioning arrangement is fabricated of steel or other suitable material.

FIG. 16 depicts an alternative embodiment of the tensioning body 200, designated by the reference numeral 200'. All other reference numerals are the same as in FIG. 15. In this embodiment, sleeve 206 provides bearing engagement with large circular aperture 60 of support plate 50, such that shoulder 204 may be eliminated. Sleeve 206 has a cylindrical configuration providing for adjustment by way of a pipe wrench or similar means (not shown). The tensioning body 200' is preferably made of metal, whereas the tensioning body 200 of FIG. 15 is designed to be fabricated from a suitable plastic material.

Figures 17, 18, 19, 20:
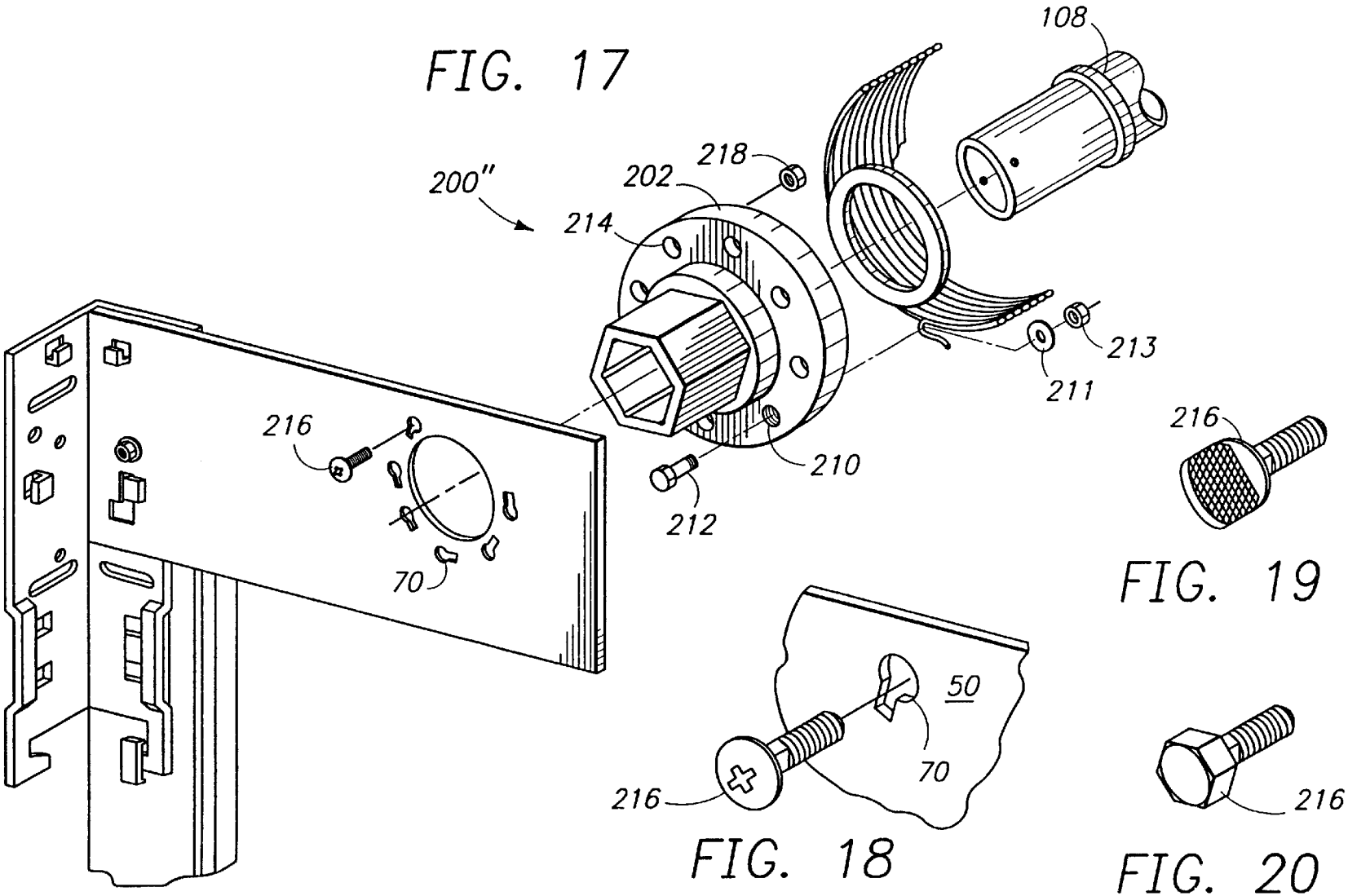
FIG. 17 is an exploded perspective View of a second embodiment of the present invention, showing the torsion spring assembly, the adjustable tensioning arrangement, the axle, and the support plate illustrating the construction thereof.
FIG. 18 is an exploded perspective view of the positioning pin and the support plate illustrating the detail thereof.
FIG. 19 is a perspective view of another embodiment of the positioning pin of FIG. 18.
FIG. 20 is a perspective view of still another embodiment of the positioning pin of FIG. 18.

Referring now to FIG. 17, another alternative embodiment of the adjustable tensioning arrangement of FIG. 15 is shown, designated by the reference numeral 200". For other elements corresponding to the structure depicted in FIG. 15, the same reference numerals are used in FIG. 17. In this embodiment, support plate 50 defines a plurality of keyhole-shaped apertures 70 surrounding large circular aperture 60 and positioned radially outward about large circular aperture 60. Keyhole-shaped apertures 214 consist of a generally circular portion with a generally rectangular "slot" portion extending therefrom.

Keyhole-shaped apertures 70 are positioned such that the generally rectangular slot portion of each aperture is aligned about the circumference of a circle axially aligned with and surrounding large circular aperture 60.

Mounting plate 202 of tensioning body 200" has a plurality of apertures 214 extending therethrough. Apertures 214 are axially aligned with and circumferentially spaced about axle bore 208.

In this embodiment, positioning pin 216 may comprise a carriage bolt, as shown in further detail in FIG. 18. Circular portion 70*a* of keyhole-shaped aperture 70 is adapted to receive the cylindrical threaded portion of positioning pin 216. Generally rectangular slot portion 70*b* of keyhole-shaped aperture 70 is adapted to receive the unthreaded, square cross-sectioned shoulder portion of positioning pin 216.

The embodiment of FIG. 17 has the advantage that manipulation of the positioning pin 216 in the aperture 70 is easier. In this embodiment there is no need to hold the positioning pin 216 against rotation when tightening or loosening the pin retaining element, such as the nut 218, as in other embodiments. The generally circular portion 70*a* of keyhole-shaped aperture 70 permits the insertion of positioning pin 216. After positioning pin 216 is passed through the generally circular portion 70*a* of one of keyhole-shaped apertures 70 and one of apertures 214 of mounting plate 202, to be retained by threaded engagement with nut 218, tensioning body 200" may be rotated to bring the square cross-sectioned portion of positioning pin 216 into secure engagement with the slot portion 70*b* of keyhole-shaped aperture 70. In so doing, undesired rotation of positioning pin 216 is precluded and the safety and ease in securing of the torsion spring tensioning arrangement is greatly enhanced.

FIG. 19 shows an alternative configuration of positioning pin 216. A thumb turn head is provided for increased ease of use.

In FIG. 20, still another alternative configuration of positioning pin 216 is shown. A hex head is provided for engagement by a wrench or pliers for ease of assembly and use.

Although there have been described hereinabove various specific arrangements of an ADJUSTABLE TENSIONING ARRANGEMENT FOR MODULAR SECURITY DOOR SYSTEM in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A roll-up door system for mounting in a door opening, said door system comprising:

vertical guide members mountable along side edges of said door opening for guiding the edges of said door as it is raised and lowered;

a pair of plate support brackets for installation at the top of said vertical guide members in positions extending above the top edge of the door opening;

a pair of support plates for mounting onto said plate support brackets in positions extending inwardly from the top of the door opening;

a barrel assembly mounted for rotation about a central axle adapted to rotatably engage said support plates; and a roll-up door mounted to said barrel assembly for rolling thereabout as the door is raised;

said barrel assembly including rotational tensioning means incorporating a spiral torsion spring anchored at one end to said axle for balancing the forces required to raise and lower said door;

an adjustable tensioning body for selectively modifying the torsional force provided by said torsion spring when said system is installed to cover said door opening with opposite ends of said axle extending through circular openings in said support plates, said adjustable tensioning body having an extended sleeve portion with a central bore for receiving one end of said axle therein and a circular bearing surface for mounting within said circular opening;

means for adjustably attaching said body to said first support plate in a selected angular position with respect to said circular opening; and means for attaching said body to said torsion spring to control the tension of said torsion spring by rotating said body relative to said first support plate.

2. The system of claim 1 wherein said first support plate has a plurality of mounting holes substantially equally spaced about said circular opening and wherein said adjustable tensioning body further includes a radially extending mounting plate having a plurality of holes spaced about said bore to permit the insertion of a positioning pin through holes in each of the mounting plate and the support plate to fix said tensioning body in a selected angular position.

3. The system of claim 2 wherein the number of holes in said mounting plate corresponds to the number of holes in said support plate.

4. The system of claim 3 wherein the number of mounting holes in each of said support plate and said mounting plate is four and said holes are spaced at 90° increments about the position of the axle.

5. The system of claim 1 further including a first retaining ring on the side of said mounting plate adjacent said torsion spring and a second retaining ring encircling said tensioning body bearing surface on the side of said first support plate remote from said mounting plate.

6. The system of claim 1 wherein said extended sleeve portion includes means for engagement thereof by an adjusting tool for adjusting the angular position of said body.

7. The system of claim 6 wherein said means for engagement comprise a plurality of flats spaced about said extended sleeve portion on the side of said first support plate remote from said mounting plate to permit engagement by a wrench.

8. The system of claim 7 wherein said tensioning body is formed of a plastic material.

9. The system of claim 6 wherein said tensioning body is formed of metal and said extended sleeve portion has a cylindrical outer surface adapted for engagement by a pipe wrench.

10. The system of claim 2 wherein the mounting holes of said first support plate comprise keyhole-shaped apertures having a generally circular portion and a generally rectangular slot portion extending therefrom adapted to receive said positioning pin and prevent rotation thereof when said pin is moved into said slot portion.

11. The system of claim 10 wherein said pin comprises a bolt having a head and a threaded body portion with a square shoulder portion between said head and body portion.

12. The system of claim 11 wherein said pin is a carriage bolt.

13. The system of claim 11 wherein said head is provided with an axially projecting flat portion for gripping between thumb and forefinger of the user.

14. The system of claim 11 wherein said pin is provided with a hexagonal head for engagement by a wrench or pliers.

* * * * *